United States Patent [19]

Webb

[11] 4,312,088

[45] Jan. 26, 1982

[54] PORTABLE BED ADJUSTING DEVICE FOR PATIENTS AND THE LIKE

[76] Inventor: Norma M. Webb, 1532 Alison Dr., West Chester, Pa. 19380

[21] Appl. No.: 144,377

[22] Filed: Apr. 28, 1980

[51] Int. Cl.[3] ..... A47C 21/00; A47C 31/00

[52] U.S. Cl. ..... 5/509; 5/11; 5/411

[58] Field of Search ..... 5/508, 509, 411, 503, 5/11, 62; 248/188.4

[56] References Cited

U.S. PATENT DOCUMENTS

| | | | |
|---|---|---|---|
| 1,670,601 | 5/1928 | Weaver | 5/509 |
| 2,067,515 | 1/1937 | Twomey | 5/411 |
| 2,072,791 | 3/1937 | Baer | 5/508 X |
| 2,147,538 | 2/1939 | Maquire et al. | 5/411 |
| 3,310,289 | 3/1967 | Burke | 5/509 X |
| 3,795,925 | 3/1974 | Leaqus, Jr. | 5/310 X |

*Primary Examiner*—Stephen J. Novosad
*Attorney, Agent, or Firm*—Robert B. Frailey

[57] ABSTRACT

A portable device for raising one end of a bed a selected height, to incline the mattress longitudinally without consequent displacement, to provide comfort for a sleeper suffering from ailments such as a hiatal hernia, cardiac failure, varicose veins or phlebitis. The device includes bed elevating blocks adapted to be inserted under one end of the bed and longitudinally extending mattress retainers adapted to be inserted between the mattress and the mattress support, such as a box spring, to secure the mattress against longitudinal movement when the bed is inclined. The bed elevating blocks may be constituted of two separate, connectable components which are adjustable relative to each other to provide selectivity in the elevation of one end of the bed. The mattress retainers are constituted of two separate, longitudinally aligned, detachably connectable, L-shaped elements, each of the elements having a short perpendicular leg, the two legs extending in opposite directions. The oppositely disposed short legs function as grips for engaging, respectively, the mattress and the mattress support, thereby preventing the mattress from moving relative to its support.

12 Claims, 10 Drawing Figures

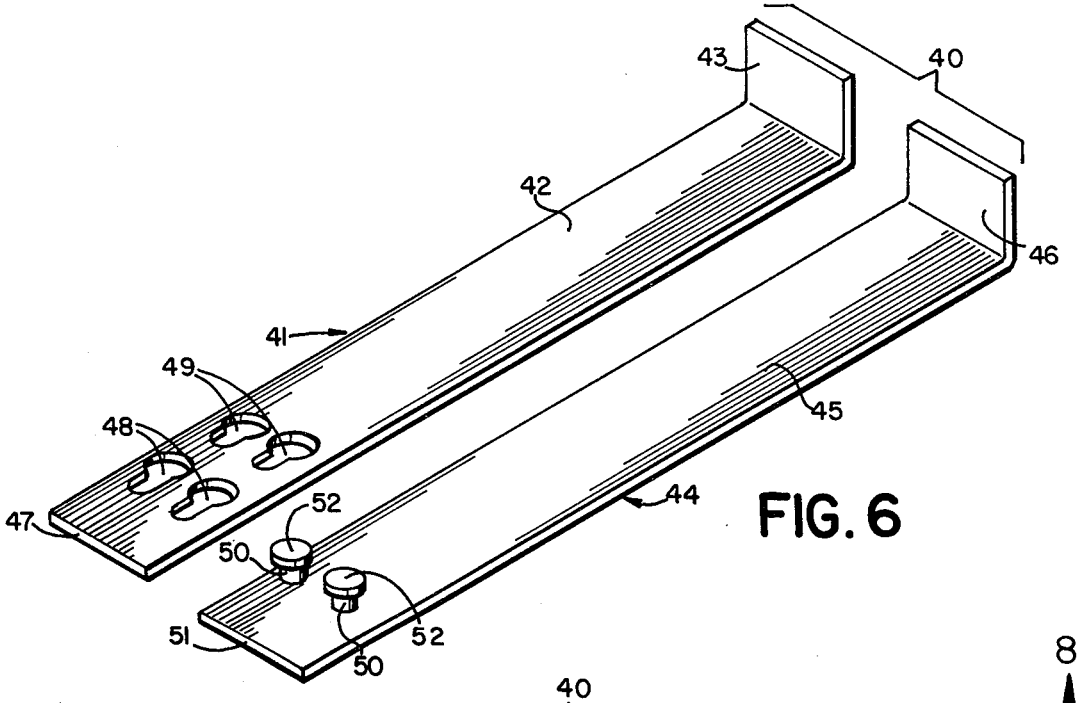
FIG. 6
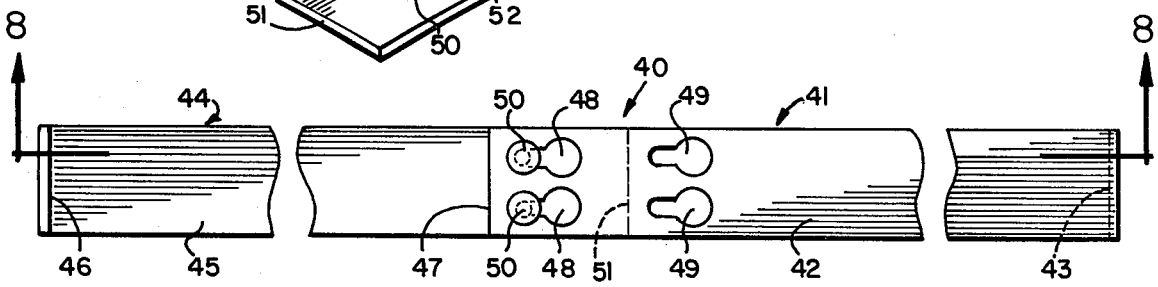
FIG. 7
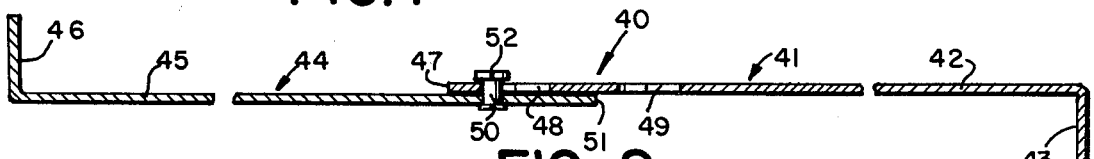
FIG. 8
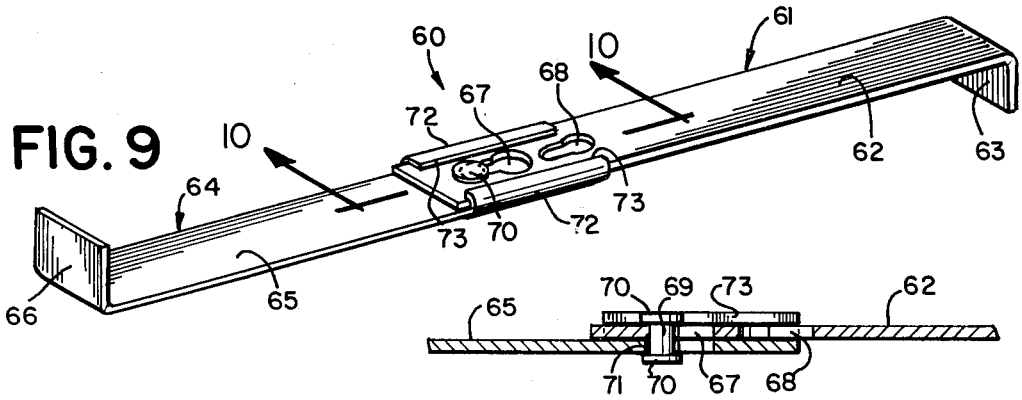
FIG. 9
FIG. 10

PORTABLE BED ADJUSTING DEVICE FOR PATIENTS AND THE LIKE

BACKGROUND OF THE INVENTION

This invention relates to a device in the nature of accessory implements for a standard or conventional bed to elevate the bed at one end to incline its mattress longitudinally without displacing the mattress relative to the bed.

A great many people—and not all of them hospital patients—suffer from physical ailments which require, or are relieved by, sleeping in a longitudinally inclined position. Such physical ailments include hiatal hernias, cardiac failure and respiratory difficulties, in respect to which it is desirable, and often necessary, to sleep with the head elevated. Other physical conditions, such as phlebitis or varicose veins, often require sleeping with the feet and legs elevated.

The therapeutic value and comfort realized by hospital patients and other persons who suffer from physical ailments such as those described above, by sleeping in beds in which the mattresses are disposed in an inclined longitudinal plane, are well known. Many devices, accessories and arrangements have been suggested for modifying a bed to achieve the desired angular adjustment. But most solutions provide either for the special construction of an entire bed incorporating such adjustment means—which is costly, but satisfactory for hospital use—or for accessories or attachments which, because of their size and weight, must be stored in the vicinity of the bed or beds for which they are to be used. Examples of known arrangements for raising one end of the bed, to incline its mattress longitudinally, may be seen from U.S. Pat. Nos. 3,110,039, 3,259,921 and 3,795,925. Further, examples of known devices for retaining a mattress against slippage or displacement, when one end of the bed is elevated, are shown in the following U.S. Pat. Nos.: 1,683,795, 2,067,515, 2,082,131, 2,147,538 and 4,017,919.

However, a serious problem arises for persons who suffer from such ailments in a mild way, but are otherwise healthy and ambulatory, and who travel with some frequency, such as hotel transients, tourists, traveling business people and the like. Usually, hotels, motels and similar organizations catering to the traveling public do not provide either adjustable beds or bed adjusting means whereby their beds may be inclined longitudinally for guests requiring such accommodation. As far as is known, no manually portable kit or combination of bed adjusting accessories has been provided, which a traveler may readily transport with his other luggage, whereby he may easily and quickly convert a standard horizontal bed into a longitudinally inclined sleeping surface. The purpose of this invention is to provide a solution to that problem.

SUMMARY OF THE INVENTION

The primary object of the present invention is to overcome the foregoing problem by providing a new, improved, portable, practical and inexpensive device enabling a transient person, who for therapeutic reasons requires sleeping on a longitudinally inclined surface, to deal with that problem when using overnight accommodations.

Another object of this invention is to provide new and improved portable accessories for a bed, whereby the bed may be inclined longitudinally without mattress displacement preparatory to use, such accessories being light in weight, readily portable manually and easily adapted for use with any standard or conventional bed.

A further object of the invention is to provide a manually portable device for converting any standard or conventional bed to inclined disposition for therapeutic purposes, which includes interchangeable bed elevating devices selectively adjustable to elevate one end of a bed to a selected height to incline the mattress longitudinally preparatory to sleeping.

A further object is to provide a manually portable device for converting any standard or conventional bed to inclined disposition for therapeutic purposes, which includes mattress retainers adapted to be inserted between the mattress and the mattress support, such as a box spring, to hold a mattress against longitudinal displacement relative to the bed when one end of the bed is elevated.

A further object is to provide plural mattress retainers for retaining a mattress in position relative to its support when one end of a bed is elevated for therapeutic reasons, wherein each mattress retainer comprises an elongated, generally rectilinear member constituted of two separable, longitudinally aligned, L-shaped elements detachably connectable at the distal ends of their respective long legs, and wherein their respective short legs extend in opposite directions to provide grips for retaining the mattress against displacement.

A further object is to provide a mattress retainer for preventing movement of a mattress relative to a bed when the latter is inclined longitudinally, the retainer being composed of two generally similar L-shaped elements, each element having a relatively long leg and a relatively short leg perpendicular thereto, the two elements being securably detachably together in longitudinal alignment to provide a single, elongated, generally rectilinear mattress retaining member whereof the short legs constitute grips to maintain the mattress in place relative to the mattress support.

A further object is to provide such a mattress retaining device which may be readily assembled and disassembled, which is selectively adjustable as to length and which is readily portable manually for use by transient persons using overnight accommodations.

Other objects and advantages of the invention will be apparent from the following detailed description thereof in connection with the accompanying drawing illustrating preferred embodiments of the invention.

BRIEF DESCRIPTION OF THE VIEWS OF THE DRAWING

FIG. 6 is a view in perspective of two complemental L-shaped elements constituting a mattress retainer of the invention, with the two elements separated and disposed side-by-side.

FIG. 7 is a fragmentary view in top plan of the mattress retainer, with its two L-shaped elements connecting rectilinearly.

FIG. 8 is a fragmentary view in vertical section of the mattress retainer taken as indicated by the angled arrows 8—8 of FIG. 7.

FIG. 9 is a reduced view in perspective illustrating a modification of a mattress retainer of the invention.

FIG. 10 is a fragmentary view in vertical section of the modified mattress retainer taken as indicated by the angled arrows 10—10 of FIG. 9.

DETAILED DESCRIPTION OF THE PREFERRED EMBODIMENT

Figure 1:
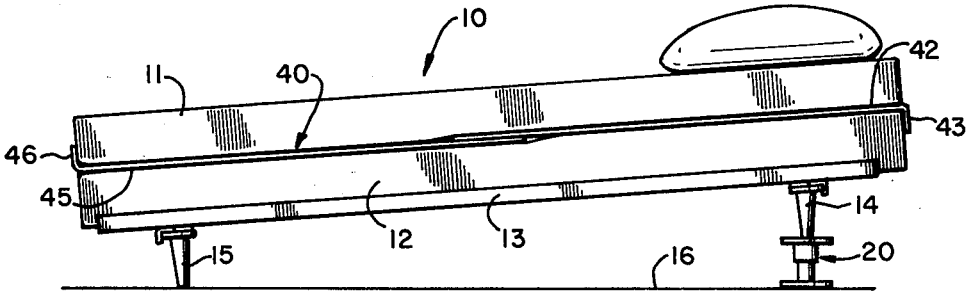
FIG. 1 is a view in side elevation of a conventional or standard type of bed embodying the preferred embodiment of this invention.

Referring now to the drawing, in FIG. 1 there is illustrated a conventional or standard bed 10 having a mattress 11, a box spring 12 comprising a support for the mattress, a frame 13 which, in turn, provides support for the box spring, and longitudianlly spaced pairs of legs 14, 15 affixed to the frame 13. The pairs of legs 14, 15 also are spaced transversely, with the legs 14 disposed at the head end of the bed and the legs 15 disposed at the foot end thereof. In normal use, the legs 14, 15 support the bed 10, and its components 11, 12 and 13, horizontally on the floor 16. However, in the practice of this invention, bed elevating blocks or devices 20 are utilized to raise one end of the bed a selected distance above the floor 16, to tilt or incline the bed longitudinally as illustrated in FIG. 1. One of the devices 20 is inserted under each of the legs 14 at the head end of the bed when that end of the bed is elevated to incline its components longitudinally. It will be understood, of course, that the elevating devices 20 may be inserted under each of the legs 15 at the foot end of the bed, thereby tilting the bed longitudinally in the direction opposite to the inclination shown in FIG. 1.

Figure 2:
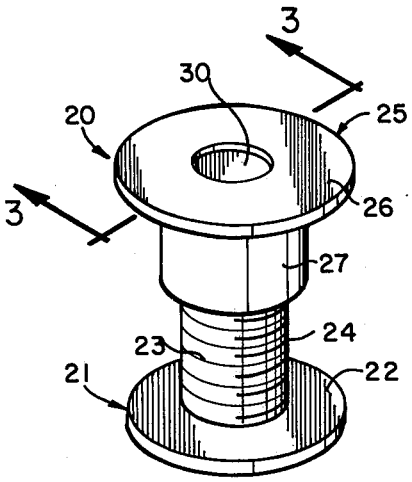
FIG. 2 is an enlarged view in perspective of one of the interchangeable elevating blocks or devices of the invention for raising one end of the bed to incline the bed longitudinally.
Figure 3:
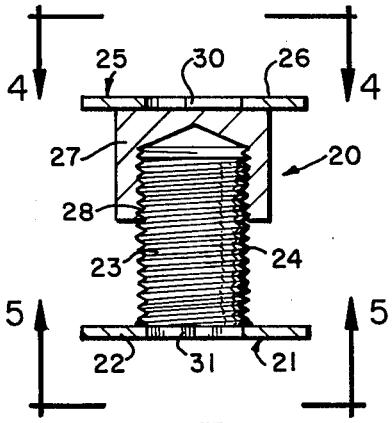
FIG. 3 is a vertical section of the elevating device taken as indicated by the angled arrows 3—3 of FIG. 2.

As illustrated in FIGS. 2 and 3, each elevating block or device 20 preferably is composed of two co-axial, complemental components 21 and 25. The lower component 21 is composed of a flange 22 and an integral cylindrical member 23 extending axially upward relative to the flange and having external threads 24 formed on its distal end. The upper component 25 similarly is composed of a flange 26 and an integral tubular or sleeve-like member extending axially downward relative to the flange and having internal threads 28 (FIG. 3). The threads 24, 28 are complementary, and permit the two components 21, 25 of the elevating device 20 to be adjusted axially relative to each other, thereby permitting their respective flanges 22, 26 to be selectively positioned vertically relative to each other after the device 20 has been inserted in place between the floor 16 and the lower end of one of the bed legs 14, as illustrated in FIG. 1. Thus, the threaded connections 24, 28 between the two components 21, 25 of each of the elevating devices 20 permit selected angular tilting or longitudinal inclination of the bed 10, as necessary or desired.

Figure 4:
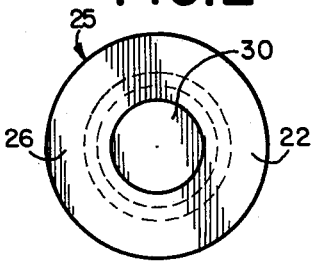
FIG. 4 is a view in top plan of the elevating device looking in the direction of the angled arrows 4—4 of FIG. 3.
Figure 5:
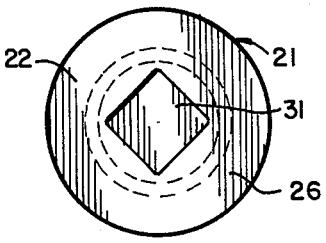
FIG. 5 is a view in bottom plan of the elevating device looking in the direction of the angled arrows 5—5 of FIG. 3.

As illustrated particularly in FIGS. 4 and 5, the outer surface of one of the flanges, e.g. flange 26, may be provided with a circular depression or cavity 30 while the outer surface of the other flange may be provided with a rectangular cavity or depression 31. The purpose of the depressions 30, 31 in the surfaces of the flanges 22, 26 is to furnish stability in the practice of the invention by providing openings or notches for engaging the distal ends of the legs 14 or 15 of the bed 10. Depressions 30, 31 serve to prevent the legs of the bed from slipping off of the elevating devices 20 during use of the invention. Circular and/or rectangular configuration of the depressions 30, 31 permits their ready adaptation to variations in the cross sections of the bed legs 14, 15. As will be readily understood, the elevating blocks 20 may be inverted in use, as necessary or desired, depending on the cross-sectional configurations of the bed legs, i.e. with either of flanges 22 or 26 resting on the floor 16 and its opposing flange 26 or 22 being selectively elevated above the floor for engagement with the adjacent bed leg.

Referring next to FIGS. 6–8, there is illustrated the preferred form of the elongated mattress retainer 40 of the invention. The mattress retainer 40 is composed of two separate, connectable, generally similar L-shaped elements 41, 44 which are secureable detachably in longitudinal alignment to each other to provide an elongated, generally rectilinear support member for the mattress 11 when the bed 10 is inclined longitudinally by the elevating devices 20. The L-shaped element 41 is provided with a long leg 42 and a short leg or offset 43 extending perpendicularly of the long leg, while the L-shaped element 44 is provided with a similar long leg 45 and perpendicular short leg or offset 46. The distal end 47 of the L-shaped element 41 is provided with two or more longitudinally spaced pairs of transversely separated keyhole-like openings 48, 49 for selected engagement with a pair of complemental, transversely spaced pins 50 affixed to the distal end 51 of the other L-shaped element 44. The two pins 50 are each provided, at their upper ends, with circular caps or flanges 52 to aid in detachably securing together the two L-shaped elements 41, 44 when those elements are connected axial alignment upon the engagement of the pins 50 with one of the pairs of shaped apertures 48, 49.

When connecting the two L-shaped elements 41, 44 together, they first are disposed with their respective distal ends 47, 51 in generally superimposed relationship, with their respective short legs 43, 46 extending in opposite directions in the manner illustrated in FIG. 8. Thereupon, the caps 52 of the pins 50 are inserted upwardly through the enlarged portions of the selected apertures 48 or 49, to emerge from the opposite side thereof. The two L-shaped elements then are retracted slightly relative to each other to engage the pins 50 in the reduced portions of the selected apertures. The diameter of the caps 52 at the top of the pins 50 is larger than the width of the reduced areas of the apertures 48, 49, thereby ensuring that the two elements 41, 44 of the mattress retainer 40 are secured firmly together. As will be observed, the connection constituted by the complemental pins 50 and apertures 48 or 49 has capacity for quick detachability. The length of the generally rectilinear mattress retainer 40 may be varied by selection of the desired set or pair of apertures 48 or 49, or of other apertures, if provided.

The function and use of the mattress retainer 40 is illustrated in FIG. 1. Preferably, two or more mattress retaining members 40 are inserted between the mattress 11 and the box spring 12. They extend longitudinally therebetween from the head end to the foot end of the bed 10. The oppositely extending short lgs or offsets 43, 46 function as longitudinally spaced grips or bed engaging means, the lower one 46 of which extends upwardly and engages the mattress 11 at the lower end of the bed while the higher leg 43 extends downwardly and engages the box spring 12 at the opposite, upper end of the bed. In this manner, the mattress retaining members 40 function to secure the mattress 11 against longitudinal displacement relative to the box spring or mattress support 12 when the bed 10 is displaced angularly to incline the mattress longitudinally. Thus, when one end of the bed is elevated—and it may be either the head end or the foot end, depending on the circumstances giving rise to the use of the invention—the mattress retainers 40 prevent the mattress 11 from sliding longitudinally relative to the bed 10.

The securing or connection means constituted by the pins 50 and the openings 48 or 49 not only function to permit longitudinal adjustment of the length of the elongated mattress retainer 40, but also function as disassembly means permitting the ready separation of the two L-shaped retainer elements 41, 44, as illustrated in FIG. 6, for ease of handling and portability. Thus, the elements of the invention, constituted by the elevating devices 20 and L-shaped mattress retainer elements 41, 44, readily adapt themselves for use as a kit, i.e. a packageable set of implements readily portable manually for immediate use whenever and wherever desired.

A modification of the mattress retainers of this invention is illustrated in FIGS. 9 and 10. More particularly, there is shown a modified mattress retainer 60 constituted of two separable, complemental, rectilinearly aligned L-shaped elements 61, 64. Element 61 is constituted of a long leg 62 and a perpendicular short leg or offset 63, while element 64 is composed of long leg 65 and short leg or offset 66.

The distal end of the long leg 65 of the L-shaped element 64 is provided with an aperture 71 (FIG. 10) designed for the ready reception of a short pin 69 having a pair of axially spaced, enlarged circular caps 70 affixed at its opposite ends. Two or more longitudinally spaced keyhole-shaped holes 67, 68 are formed in the distal end of the long leg 62 of the L-shaped element 61. The enlarged portions of the holes or apertures 67, 68 are formed complementally to the shape of the hole or opening 71.

When hole 71 is aligned axially with the enlarged area of either hole 67 or hole 68, pin 69 with its caps 70 may be readily inserted through the superimposed, congruent openings. Thereupon, the two L-shaped elements 61, 64 are retracted longitudinally slightly away from each other, to engage the pin 69 within the smaller portion of the selected aperture 67 or 68, thereby connecting the two elements constituting the mattress retainer 60. As will be understood, the pin 60 may be readily disengaged from the smaller portion of the selected aperture and then removed from the assembly, following which the structure 60 may be collapsed longitudinally. If desired, suitable retaining means (not shown) may be provided for the pin 69 and its enlarged caps 70 to hold the pin captive within the aperture 71, with capacity for both axial and transverse displacement relative thereto, for engagement with, and disengagement from, one of the keyhole-shaped openings 67 or 68.

Also affixed to the distal end of the long leg 65 of the L-shaped element 64 are a pair of transversely spaced, longitudinally extending, upstanding guides or channels 72, the upper portions of which are formed into opposing, inwardly curved lips 73 which overlie transversely spaced segments of the longitudinal edge areas of the long leg 62 of the L-shaped element 61. As will be readily understood, the detachable securing means constituted by the pin 69 and the complemental apertures 67 or 68, in association with the spaced guides 72, permits the two L-shaped elements 61, 64 to be extended telescopically relative to each other, preparatory to use of the mattress retainer 60, and to be contracted telescopically relative to each other, when the mattress retainer 60 is disassembled preparatory to portability. If desired, the distal ends of the L-shaped elements 61, 64 may be provided with suitable stops (not shown) or similar means, whereby the two elements may be retained at all times, during use and during disassembly or portage, in telescopic relation to each other.

Preferably, the components constituting the invention are fabricated of lightweight, strong and non-brittle materials, such as extruded aluminum or a molded plastic material. Ease of manual portability is a particular advantage of the invention, permitting travelers, such as hotel transients and tourists, who suffer from such physical ailments as hiatal hernias, respiratory problems, phlebitis, etc., to sojourn without encountering discomfort or more serious difficulties during sleep. By providing the invention in the form of a kit, package or combination readily portable manually, a traveler suffering from physical ailments requiring elevation of a bed into an inclined plane may readily adjust any conventional bed to such condition. The invention is applicable with any standard type of bed, including Hollywood beds, beds having both headboards and footboards, angle iron frame beds, etc.

While it is preferred that the bed elevating blocks 20 be composed of two complemental, adjustable components 21 and 25, it is within the scope of this invention to provide the devices 20 in integral, non-adjustable, preferably spool-shaped form, either molded of a suitable lighweight plastic material or extruded or cast of a strong, lightweight metal, such as aluminum. In practice, it usually is preferred that the elevating devices 20 be effective to raise one end of the bed a distance of from 6" to 8".

Mattresses usually are provided in longitudinal lengths of about 75" or 80", and it is preferred that the mattress retaining members 40, 60 of the invention be adjustable selectively to either of those lengths. By way of example, the L-shaped elements 41, 44, 61, 64, may be provided with long legs of 44", short legs of 4" and widths of approximately 6". The ends of the narrow portions of the outer apertures 48, 67 may be spaced 4" inches from the distal ends of the elements 41, 61, and the ends of the narrow portions of the inner aperture 49, 68 may be spaced 9" therefrom. The pins 50 and the aperture 71 may be spaced a sufficient distance from the distal ends of their corresponding elements 44 or 64 to provide adjustable lengths for the mattress retainers 40, 60 of either 80" or 75", depending on the apertures selected.

Although a preferred embodiment of this invention has been shown and described herein for the purpose of illustration, as required by Title 35 U.S.C. 112, it is to be understood that various changes and modifications may be made therein without departing from the spirit and utility of the invention, or from the scope thereof as set forth in the appended claims.

I claim:

1. In a portable kit for inclining a conventional bed for use by a sleeper requiring therapeutic treatment, said bed including a head end, a foot end, plural legs at each end for supporting the bed on a floor, a mattress support and a mattress resting on the mattress support, the combination comprising:

(a) bed elevating means adapted to be inserted under one end of the bed and operable to raise said end to a selected height to incline the bed longitudinally and (b) mattress retaining means comprising at least one elongated, generally rectilinear member adapted to be inserted between the mattress and the mattress support and to extend longitudinally from the head end to the foot end of the bed, said retaining means being operable to secure the mattress against displacement relative to the mattress support when the bed is inclined, (c) each said elongated member of said mattress retaining means having longitudinally spaced bed engaging means, one said bed engaging means comprising an offset extending generally perpendicularly from the member in the direction of the mattress support and being engageable therewith, and one said bed engaging means comprising an offset extending generally perpendicularly from the member in the direction of the mattress and being engageable therewith.

2. The portable kit of claim 1, wherein:

(a) each elongated member comprises a pair of L-shaped elements, each said L-shaped element having one long leg and one short leg, (b) complemental securing means are located at the distal ends of the long legs of the two L-shaped elements for detachably securing said distal ends together, said securing means being operative to secure the two L-shaped elements whereby the long legs of the two elements are aligned rectilinearly and the short legs of the two elements extend in opposite directions relative to each other, and (c) the said two short legs constitute the longitudinally spaced perpendicular offsets engageable, respectively, with the mattress support and the mattress.

3. The portable kit of claim 2, wherein the means for securing the two L-shaped elements detachably together includes means for adjusting selectively the length of the elongated member constituted of said elements.

4. The portable kit of claim 2, wherein the detachable securing means for the two L-shaped elements includes means operable to permit the two elements to be disassembled and separated, one from the other, preparatory to portability.

5. The portable kit of claim 2, wherein the detachable securing means for the two L-shaped elements includes means operable to permit said elements to be extended telescopically relative to each other preparatory to use, and to be contracted telescopically relative to each other preparatory to portability.

6. The portable kit of claim 1, wherein the bed elevating means comprises at least two interchangeable elevating blocks, each said block comprising two complemental components selectively adjustable vertically relative to each other.

7. The portable kit of claim 6, wherein each bed elevating block comprises:

(a) two coaxial components, each component comprising a flange and a member extending axially from the flange, (b) the flange of one component being adapted to rest on the floor and the flange of the other component being adapted to engage one of the legs of the bed above the floor, and (c) adjustment means comprising complemental threads formed on the axially extending members of the two components for engaging the two components threadingly, whereby said two flanges may be adjusted vertically relative to each other.

8. In combination with a conventional bed having a head end, a foot end, plural legs at each end for supporting the bed on a floor, a mattress support and a mattress resting on the mattress support, accessory means for modifying the bed for therapeutic use comprising:

(a) at least two bed elevating devices adapted to be inserted under the legs at one end of the bed to raise said end to incline the bed longitudinally, (b) said elevating devices being adjustable vertically relative to the floor, and (c) at least two transversely spaced, longitudinally extending mattress retainers adapted to be inserted between the mattress and the mattress support to secure the mattress against displacement relative to the mattress support when the bed is inclined, (d) each said mattress retainer having perpendicularly extending, oppositely disposed gripping means for engaging the mattress support and the mattress.

9. The invention of claim 8, wherein (a) each mattress retainer comprises a pair of complemental L-shaped elements, each said L-shaped element having one relatively long leg and one relatively short leg perpendicular thereto, (b) securing means connect detachably the distal ends of the long legs of the two L-shaped elements, whereby the long legs of said two elements are aligned rectilinearly and the perpendicular short legs of the two elements extend in opposite directions relative to each other, and (c) the said two short legs constitute the gripping means for engaging the mattress support and the mattress.

10. The invention of claim 9, wherein (a) the mattress retainers are elongated and extend from the head end to the foot end of the bed and (b) adjustment means disposed on the distal ends of the relatively long legs of the two L-shaped elements permit selective adjustment of the length of the retainers relative to the length of the bed.

11. The invention of claim 8, wherein each bed elevating device comprises:

(a) two coaxial components, each component comprising a flange and a member extending axially from the flange, (b) the flange of one component being adapted to rest on the floor and the flange of the other component being adapted to support one of the legs of the bed at a selected elevation above the floor, said two flanges being spaced apart vertically by the axially extending members which are disposed between and connected together intermediate of the two vertically spaced flanges, (c) the connection between the two axially extending members including adjustment means operative for adjusting the two components vertically relative to each other.

12. The invention of claim 11, wherein the accessory means is manually portable, and includes disassembly means for disassembling the mattress retainers preparatory to portability.

* * * * *